United States Patent [19]

Fredrickson

[11] Patent Number: 4,562,927

[45] Date of Patent: Jan. 7, 1986

[54] DISPLAY RACK

[75] Inventor: Howard J. Fredrickson, Cannon Valley Township, Goodhue County, Minn.

[73] Assignee: Cornelius Cannon Inc., Cannon Falls, Minn.

[21] Appl. No.: 492,067

[22] Filed: May 6, 1983

[51] Int. Cl.[4] ..... A47F 7/00

[52] U.S. Cl. ..... 211/59.2; 211/194; 312/257 SM

[58] Field of Search ..... 211/49 D, 74, 128, 188, 211/186, 194, 187; 312/108, 257 SK, 257 SM, 257 A; 108/109

[56] References Cited

U.S. PATENT DOCUMENTS

| | | | |
|---|---|---|---|
| 2,375,726 | 5/1945 | Bales | 108/109 |
| 2,761,568 | 9/1956 | Temple | 211/186 X |
| 2,801,752 | 8/1957 | Jakubowski | 211/194 X |
| 3,203,554 | 8/1965 | Pendergrast, Jr. et al. | 211/49 D |
| 3,279,618 | 10/1966 | Bergstedt | 211/49 D |
| 3,295,902 | 1/1967 | Doutt | 108/109 X |
| 3,465,898 | 9/1969 | Klein | 211/188 X |
| 3,628,807 | 12/1971 | Fullington et al. | 211/128 X |
| 3,777,897 | 12/1973 | Gray | 211/186 X |
| 3,881,428 | 5/1975 | Klecki | 211/186 X |
| 3,970,199 | 7/1976 | Marschak | 211/188 X |
| 4,045,104 | 8/1977 | Peterson | 312/257 SK X |
| 4,064,995 | 12/1977 | Bustos | 211/187 |
| 4,317,523 | 3/1982 | Konstant et al. | 211/187 |

FOREIGN PATENT DOCUMENTS

| | | | |
|---|---|---|---|
| 441801 | 1/1936 | United Kingdom | 312/108 |

*Primary Examiner*—Robert W. Gibson, Jr.
*Assistant Examiner*—Blair M. Johnson
*Attorney, Agent, or Firm*—Henry C. Kovar

[57] ABSTRACT

A display rack has a pair of opposed end sides, a plurality of spaced apart transverse shelves that are tilted forward in between the sides and a planar back panel attached to the sides; the rack is intended for the upright display and selling of large bottles of soft drinks and the rack features a novel construction wherein the structure is made of smaller parts enabling a kit for the rack to be easily shipped and packaged, and the rack features novel high end graphics; each end side has an upper and lower segment that are each shorter than a shelf, each end has a billboard that is in two sections and each section is shorter than a shelf, and the back panel is divided into segments with each segment being of no greater width than the depth of a shelf.

20 Claims, 8 Drawing Figures

DISPLAY RACK

BACKGROUND OF THE INVENTION

1. Field of the Invention

This invention pertains to a display rack, and in particular to a novel construction of reduced size components making a relatively large rack. 2.

2. The Prior Art

The typical prior art display rack of this type has a base, four corner posts, a structural cap that carries external advertising and an internal translucent light diffuser panel, and a group of shelves for bottles. Gravity feed of upright bottles in a line is well known and has been used. Some racks hang bottles by the necks. Some racks have flat shelves. All of these racks look excessively structural. None of the racks have large display signs. Existing racks have X-member back frames of flat wire, or have no back frame and are quite shakey; the only way for structural strength is with very heavy corner posts or the X-frame. Big flat sheet metal back panels have not been used in kit form racks because of shipping difficulty. You cannot economically ship a single panel of sheet metal five feet by seven feet in size. Assembled racks have never been successful because manufacturers cannot economically inventory, shipping costs are prohibitive, and damage in transit is too often incurred. The tall end side panels have been a problem; they can only be shipped by truck as parcel services will not handle them. Large display panels or billboards have also not been used because they cannot be shipped. In the existing racks, there is no procedure for updating ad copy presentation. The most relevant known existing rack is made by Masterack of Atlanta and has four posts, four open sides, a large and thick base to stiffen the four corner posts, a large four-sided hat-band type top to present ad copy and again to stiffen the corner posts, and a wire X-brace in the back. I am presently unaware of pertinent patented structures.

In summary, existing display racks for bottles are much too like structural steel work; they have not been well thought out and they are difficult to ship from manufacturer to retailer.

OBJECTS OF THE INVENTION

It is an object of the present invention to provide a display rack having a planar panel that is easily packaged and transported.

It is an object of the present invention to provide a display rack having relatively tall end sides that have upper and lower segments which are easily packaged and shipped.

It is an object of the present invention to provide a display rack having an improved top construction for presenting advertising, for aesthetic appearance, for strength, low cost and ease of assembly.

It is an object of the present invention to provide a display rack having structure for improving the presentation of bottles to a consumer, so a consumer may see bottle and bottle cap ad copy and easily remove bottles from the rack.

It is an object of the present invention to provide a bottle display and retailing rack having opaque billboards on each end which present ad copy and conceal the structural interior of the rack, while the shelving is cantilevered forward of the billboard for presenting most of the lowest bottle on the shelf so a customer may see most of this bottle while approaching the rack from an end.

It is an object of the present invention to provide a kit for an upright display rack in which the kit is of a relatively small size as compared to the assembled rack.

It is an object of the present invention to provide an improved display rack having simplified and improved structure that can be easily assembled and which is quite aesthetically pleasing and which is a merchandiser of increased effectiveness.

It is an object of the present invention to provide a relatively small compact kit for a relatively large display rack, wherein the packaged kit is of a size that can be easily inventoried, handled and shipped by all shippers at an economical rate.

These and other objects of the present invention will become manifest to those skilled in the art upon examination and study and use of the teachings herein.

SUMMARY OF THE PRESENT INVENTION

In accordance with the principles of the present invention, a display rack has a pair of opposed end sides, shelves in between the sides and a segmented back panel securing the sides together; the back panel has a plurality of discrete rectangular sheet segments stacked one on top of each other with each segment having a height equal to a majority of the depth of an end side.

A display rack has a pair of opposed end sides and shelves in between the sides, with each side having an upper and lower segment, each segment having a height less than a width of the rack.

A display rack has a pair of opposed sides, a plurality of shelves, a rear top header with a panel support, a front header with a panel support, and a top panel parallel to a tilted top shelf.

A bottle display rack has a pair of opposed sides, a plurality of tilted gravity feed shelves, a bottle stop fence on the front of each shelf, bottle slideways on the shelves, and an angular stagger between the bottle fences that makes all bottle caps below eye level visible to a consumer.

A bottle display rack has end sides with full height opaque billboards which conceal the interior of the rack, and bottle shelves each having a cantilevered front end which presents more than half of a bottle to an end view.

A kit for an upright display rack has a plurality of shelves, a pair of opposed end sides, each side having connectible upper and lower segments each shorter than a shelf, and one or more shipping cartons having a length substantially less than the height of an end side.

AS SHOWN ON THE DRAWINGS

Figure 1:
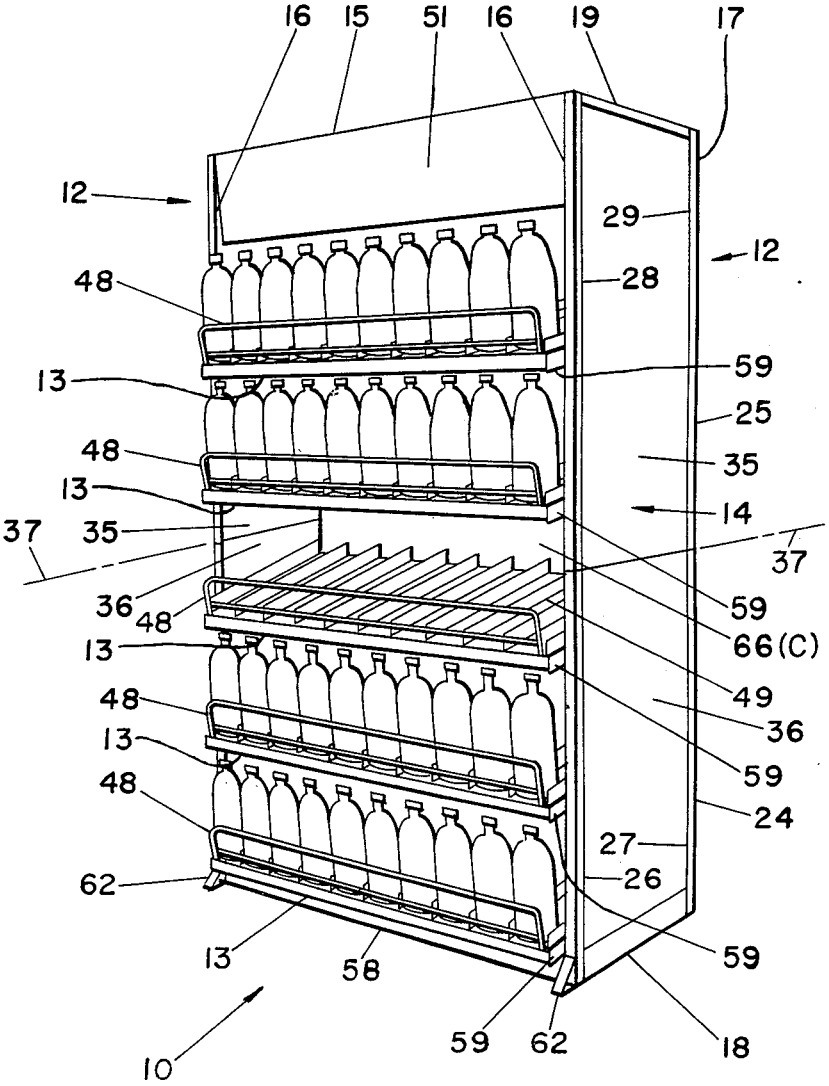
FIG. 1 is a perspective view of the preferred embodiment of the display rack of the present invention, showing the front and right end sides.
Figure 2:
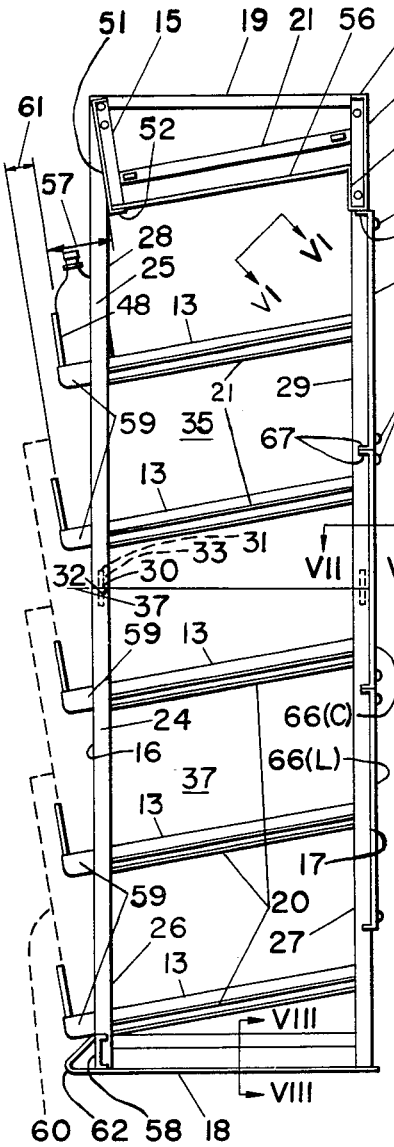
FIG. 2 is an elevational sectional view through the structure of FIG. 1, looking at the inside of the left end side.
Figure 3:
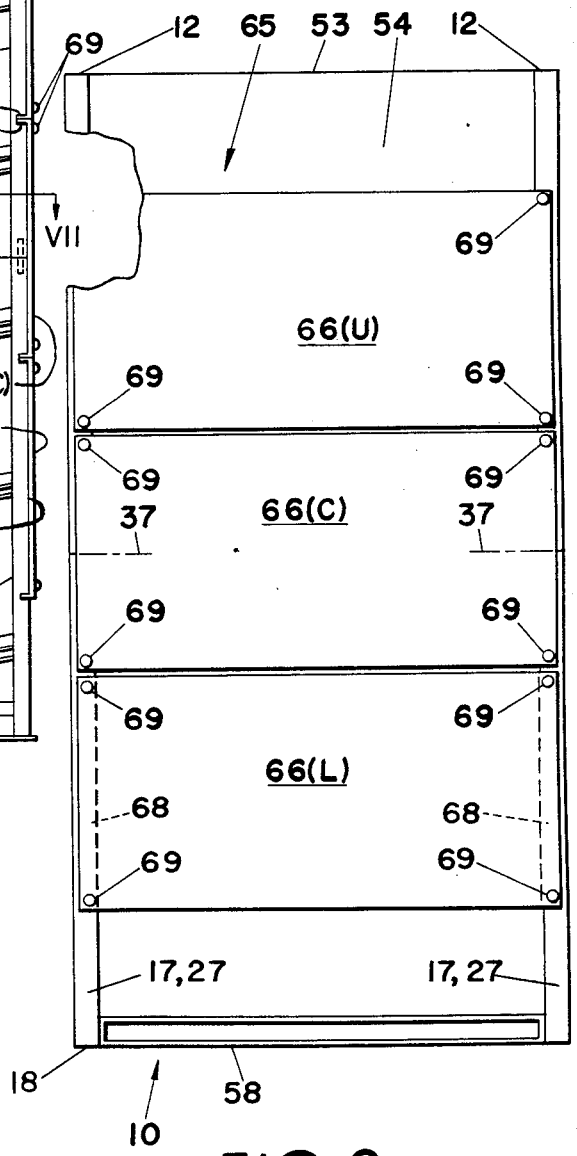
FIG. 3 is a back elevational view of the structure of FIG. 1.

The principles of the present invention are particularly useful when embodied in the preferred embodiment of a display rack, which is shown in FIG. 1 and generally indicated by the numeral 10. The rack 10 has a pair of end sides which support a plurality of shelves 13. The rack 10 preferably has a billboard 14 in each side 12 and a front header 15 for presenting enhanced graphics for point-of-sale advertisement. The rack 10 is specifically intended to display and retail 2-liter PET bottles of soft drinks, although the rack 10 may also be used for other soft drink packages, beer, wine, motor oil, aseptic box packages, seasonings, and other packaged goods.

The end sides 12 are the mirror image of one another. Each side 12 has a front stanchion 16 and a rear stanchion 17 which are spaced apart by a horizontal base 18, a horizontal top brace 19, and cross braces 20, 21. Within the stanchions 16, 17 are channels 22 for holding the billboards 14 and the base 18 has a base channel 23 for support of the lower edge of the billboard 14.

The sides 12 are quite tall, for example they may be seven or eight feet tall, and as measured by their height they are the longest component in the rack 10. Each side 12 is divided into two shorter segments, specifically a lower segment 24 which fastens to and supports an upper segment 25. The lower segment 24 has a lower front pillar 26 and a lower rear pillar 27 which are structurally spaced from each other by the base 18 and a plurality of the lower cross-members 20. The cross-members 20 are at an acute angle to the base 18 which gives the lower segment 24 an independent triangulated construction. The upper segment 25 has an upper front pillar 28, and an upper rear pillar 29 which are structurally spaced from each other by the top brace 19 and a plurality of the upper cross-braces 21. The upper cross-braces 21 are at an acute angle to the top brace 19 which gives the upper segment 25 an independent triangulated construction. The front pillars 26, 28 join together to form the front stanchion 16, and the rear pillars 27, 29 join together to form the rear stanchion 17 as will be described. The pillars 26, 27 of each lower segment 24 each have an upward facing support surface 30 and an upward extended pilot 31. The pillars 28, 29 of each upper segment 25 each have a downward facing bottom 32 and a socket clip 33 for receiving the pilot 31. The upper pillars 28, 29 register with and rest upon the lower pillars 26, 27 and a lock fastener 34 positively secures the pilots 31 and socket clips 33 and therefore the upper segments 25 to the lower segments 24. The spit level 37 where the upper segment 24 adjoins the lower segment 26 is about midway in the height of each side 12; specifically, the split level 37 is in between a central pair of shelves 13 and is at a level that provides that each of the upper segments 25 and lower segments 24 will have a height in the range of forty-five to fifty-five percent of the height of the side 12.

Each of the billboards 14 is likewise split into a discrete upper section 35 and a discrete lower section 36 which have a common split level 37 at the same height as the split level 37 of the side segments 24, 25. The billboards 14 are placed inside the stanchions 16, 17 and inside of the channels 22, 23 while the side segments 24, 25 are disassembled from each other. Each billboard section 35, 36 may carry half of an advertisement, and when the sections 35, 36 are combined, the complete message is assembled. Each of the billboard sections 35, 36 is structurally backed up by the appropriate cross-braces 21, 20 and an H-section extrusion 38 may be placed at the split level 37 between the billboard sections 35, 36 to keep the sections 35, 36 in a common plane at the split level 37.

Figure 5:
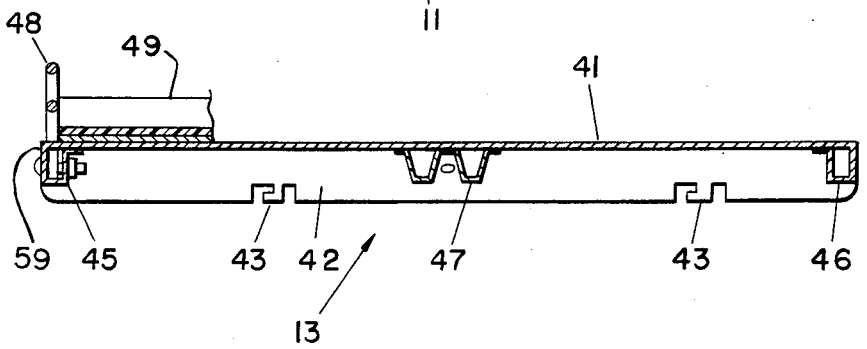
FIG. 5 is an elevational sectional view in detail of the preferred shelf in the structure of FIG. 1.
Figure 7:
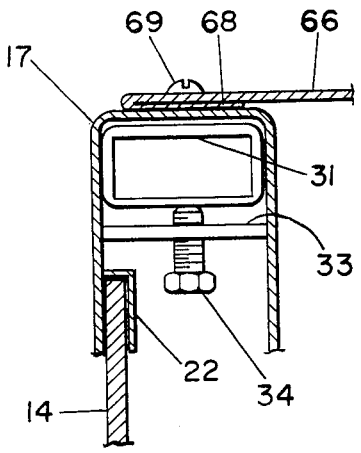
FIG. 7 is a downward looking sectional view through lines VII—VII of FIG. 2.
Figure 8:
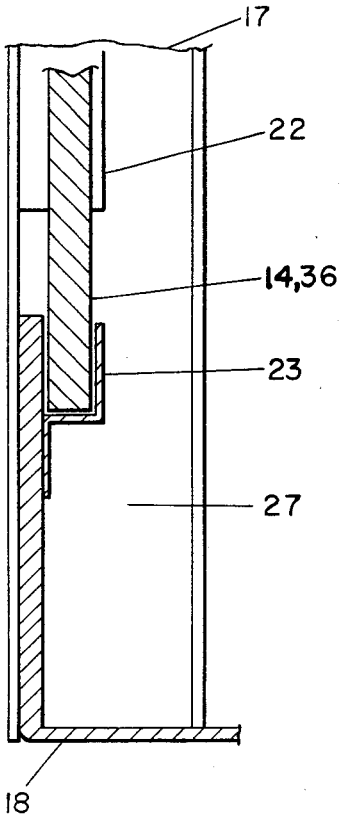
FIG. 8 is a detail view taken from lines VIII—VIII in FIG. 2.
Figure 6:
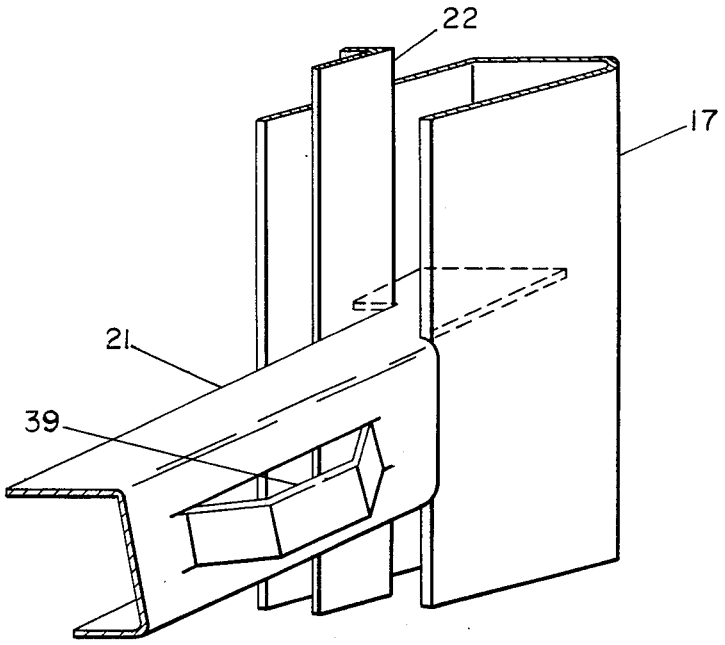
FIG. 6 is an elevational sectional view taken through lines VI—VI of FIG. 2.

As detailed in FIG. 5, each of the shelves 13 has a generally planar top surface 41 bounded on its ends by a downward extending flange 42 on each end. Each flange 42 has a tongue 43 that is positively supported and retained by a respective shelf support 39. There are two shelf supports 44 in each of the cross-braces 20, 21 for support of shelves 13 at an acute angle above the base 18, for example a preferred angle is ten degrees. Each shelf 13 has a front box section 45 at its lower edge, a back box section 46 at it upper edge, and a central box section 47 in between the tongues 43. A bottle stop fence 48 is mounted to the front box section 45 and a low friction plastic slideway 49 for bottles rests upon the shelf 13. Bottles stand upright in the slideway 49 and slide downward by gravity until stopped by the fence 48. The bottle rows are self-feeding and when the lowest bottle is removed, all the higher bottles slide down one diameter to again be stopped by the fence 48.

The front header 15 has an inwardly slanted front display panel 51 which is perpendicular to the uppermost shelf 13 and which faces directly into the eyes of a customer. At the bottom of the front panel 51 is a front support ledge 52. The sides 12 are structurally spaced from each other and held together at the top by the front header 15 and a rear header 53. The rear header 53 has a rear panel 54 which may also carry rearward facing ad copy and a rear support ledge 55 extends forward of the rear panel 54 in a J-shape. The rear ledge 55 may also carry forward directed advertisement. The rear ledge 55 extends substantially higher then the front ledge 52 and up toward the top of the rack 10. A top panel 56 rests in between the headers 15, 53 and upon the ledges 52, 55 and is held up on the ledges 52, 55 by the back side of the front panel 51. The top panel 56 is parallel to the uppermost shelf 13 and is perpendicular to the front panel 51. The front panel 51 is parallel to the top fence 48 and is spaced rearward of the fence 48 by a stagger 57 which is an amount greater than the bottle diameter. This improved new arrangement of front panel 51, ledges 52, 55 and top panel 56 presents substantially more advertisement at a better angle of presentation to the consumer, and the height of the rack 10 is decreased because of the usage of only minimal clearance between the top panel 56 and front panel 51 from the top shelf 13. The top panel 56 is preferably a transparent light diffuser panel. At the bottom of the sides 12 and between the front of the bases 18 is a base header 58 which holds the front of the bases 18 in spaced relationship.

As previously mentioned, each end side 12 has a billboard 14 which is preferably of painted fiberboard and which is opaque, for presenting advertisement and concealing the structural interior and assorted inventory or lack or inventory of the rack 10. Each shelf 13 has a centilevered front end 59 which extends forward of the front stanchions 16 so that most of the first bottle on each shelf 13 can be seen from an end of the rack and the front end 59 and the fence 48 are preferably forward of the front stanchions 16 a distance that is at least one half of the bottle diameter so that most of the lowest bottle is visible from an end of the rack 10. Each of the shelves 13 and fences 48 have an angular stagger 60 having an offset 61 that is at least one half of the bottle diameter so that on all bottles up against a fence 48, all of the bottle caps below eye level are visible and readable to a person standing at arm's length in front of the rack. This enables presentation of advertisement on the bottle cap at the moment of selection of purchase. Each end side 12 has a base toe 62 which is below the lowest shelf 13 and which is forward of the front stanchions 16 and which is generally in line with the front edge of the shelf cantilevered front ends 59 and the fences 48, to give the rack maximum stability.

At the rear of the rack 10, the end sides 12 are secured to each other and held parallel and square to the floor by a back panel 65. The back panel 65 is planar sheet metal and has a considerable area; the panel 65 is as wide as the rack 10 and has a height extending from adjacent the lowest shelf 13 to the rear header 53. The panel 65 is fastened to both of the rear stanchions 17. The back panel 65 is segmented into three segments 66, all of which are preferably identical and interchangeable. Each panel segment 66 has inward facing horizontal stiffener ribs 67 which abut against like ribs 67 of an adjacent panel segment 66 at levels in between shelves 13. Each panel segment 66 has hemmed over outer vertical edges 68 for strength and protection of the public from sharp edges. One of the panel segments 66 is an upper panel segment 66 (U), and it is abutted against the rear header 53. The upper panel segment 66 (U) is fastened to the upper rear pillars 29 only. The next lower panel segment 66 is a central panel segment 66 (C) and it spans across the split level 37 and is fastened to both the upper rear pillars 29 and the lower rear pillars 27 which also holds upper and lower side segments 25, 24 together in a square configuration. Below the central panel segment 66 (C) is another panel segment 66 which is the lower panel segment 66 (L). The lower panel segment 66 (L) is fastened only to the lower rear pillars 27. Each panel segment 66 is rectangular shaped and has a length about the same as the length of a shelf 13 and a height which is equal to a majority of the depth of the end sides 12. More specifically, each panel segment 66 has a height that is less than the depth of a shelf 13 so that the shelf 13 determines the maximum width of packaging needed, and each panel segment 66 has a height approaching but not greater than the depth of the side segments 24, 25 so that they can be packaged together. Each side segment 24, 25 has a height the same as or shorter than the length of the panel segments 66. The panel segments 66 are the longest discrete components of the rack 10 and these panel segments 66 determine the length of cartoning needed for shipping the rack 10. Each panel segment 66 is held to the rear stanchions 17 by fasteners 69; there is one fastener 69 in each of the four corners of each panel segment 66, and each fastener 69 goes through the hemmed edge 68 and into a rear stanchion 17. The lower panel segment 66 (L) individually squares up the assembly of the lower side segments 24 and the upper panel segment 66 (U) individually squares up the assembly of the upper side segments 25. Each of the assemblies can be made and handled discretely from the other and the billboard sections 35, 36 can be discretely loaded. The assembled upper side segments 25 and upper panel segment 66 (U) together with the front header 15 and rear header 53 can be placed as an assembly upon the previously assembled lower side segments 24 and lower panel segment 66 (L) and the base headers 58. Installation and fastening of the central back panel support 66 (C) then secures and squares the upper and lower side segments 25, 24 to each other. The pilots 33 can then be locked by the lock fasteners 34. If the central back panel segment 66 (C) is removed, the rack 10 can then be separated into upper and lower halves or the billboards 14 can be changed. Each of the shelves 13 has the box sections 45, 46, 47 which are structural compression members between the sides 12, while the back panel segments 66 are in tension between the rear stanchions 17. The panel segments 66 can carry further advertisement on both the back or front side.

Figure 4:
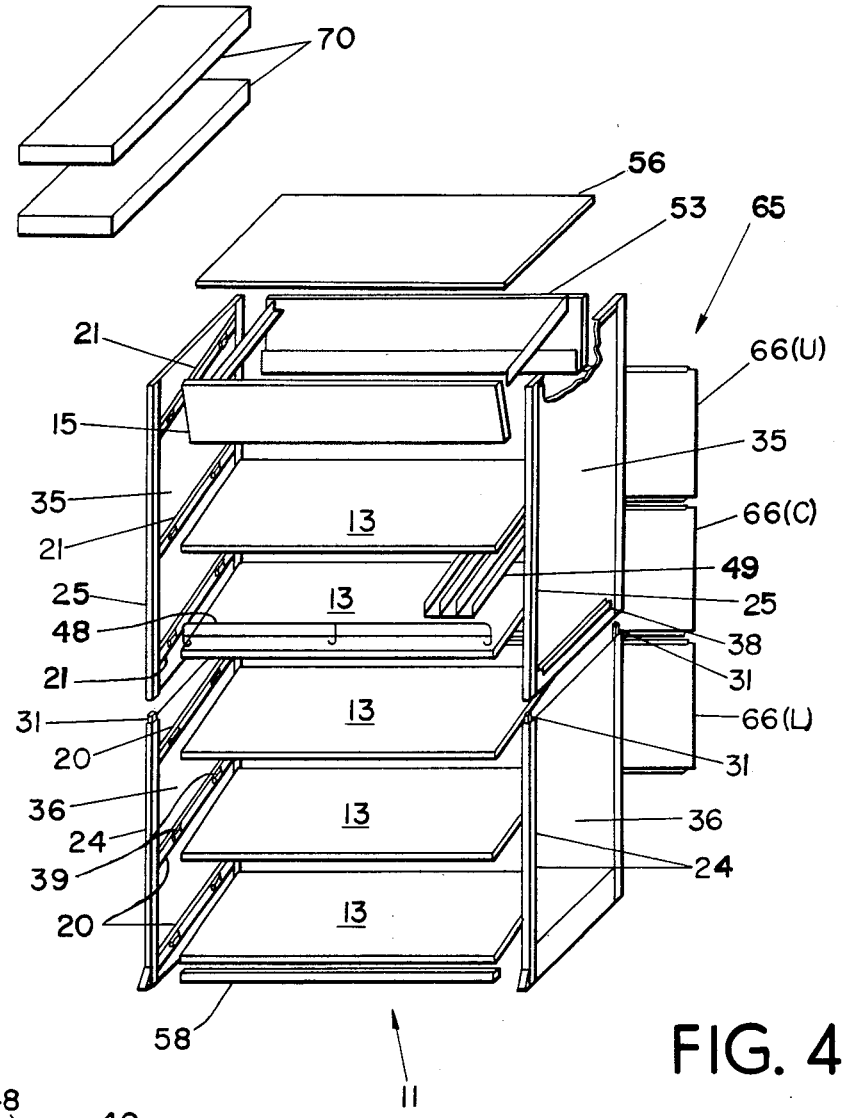
FIG. 4 is a perspective view of the disassembled components of the structure of FIG. 1.

FIG. 4 shows the rack 10 in the form of a kit 11 which is all of the discrete components in loose form in one or more shipping cartons 70. The rack 10 is a sizable device, for example a preferred model has a capacity of three hundred two-liter PET bottles, an eighty-six inch height, fifty inch width, twenty-eight inch depth and a shipping weight of 285 pounds. Rather than having to use a ninety inch carton for the sides 12, and an X-member rear brace, the side segments 24, 25 and back panel segments 66 can all be packaged in cartons 70 that have a length no more than marginally greater than the length of the shelves 13 and substantially less than the height of the end sides 12. For example, the kit 11 can be packaged in fifty inch long cartons, and the quantity of cartons will be such that the weight in each is what the buyer of the rack wants. The width of the carton is determined by the shelf depth.

The small size cartons can be handled by UPS, and all normally used channels of distribution. The kit 11 can also be carried in a station wagon or compact car. This invention provides a quite large rack 10 that can be easily shipped in relatively small cartons 70. The rack 10 will provide maximum trademark and message exposure together with low cost per bottle. The rack is easy to load and provides increased customer convenience and bottle visibility. This new rack 10 presents its goods to a customer in a convenient, efficient and highly visible manner.

Although other advantages may be found and realized, and various and minor modifications suggested by those versed in the art, be it understood that I wish to embody within the scope of the patent warranted hereon, all such embodiments as reasonably and properly come within the scope of my contribution to the art.

I claim as my invention:

1. A display rack comprising:

a. a pair of opposed end sides, each side having a front stanchion, a rear stanchion and fore-aft structures separating the stanchions, the fore-aft distance between the stanchions defining the depth of the sides, each side being segmented into an upper half and a lower half;

b. shelves in between the sides, said shelves being supported by the sides; and c. a segmented back panel securing the rear stanchions and the sides to each other, said back panel comprising a plurality of discrete rectangular sheet segments stacked one on top of the other, each segment having a height equal to a majority of the depth of the side, one of the back panel segments overlapping onto both the upper half and the lower half of both sides.

2. The rack of claim 1, in which the overlapping segment is fastened to both upper side halves and to both lower side halves.

3. The rack of claim 2, in which segment-to-side fasteners are in each corner of the overlapping segment.

4. The rack of claim 2, in which the overlapping segment is a central segment, with there being a lower segment and an upper segment.

5. The rack of claim 2, in which the segments are butted against each other.

6. The rack of claim 3, in which each segment includes horizontal stiffening ribs along both upper and lower segment edges, said ribs being staggered in between the shelves.

7. The rack of claim 6, in which the ribs are staggered in between the shelves.

8. The rack of claim 4, in which all of the segments are identical.

9. A display rack having a pair of opposed end sides, transverse structural members between the sides, and shelves in between and supported by the sides, in which each end side comprises a. a lower side segment having a base at its bottom and support means for supporting an upper segment at its top, b. an upper side segment having a bottom engaged and supported by the support means; in which c. the end sides are the longest components of the rack, while the side segments are substantially shorter and are of a length equal to or less than the width of the rack; in which d. the lowest segment has a front pillar and a rear pillar, and said base comprises a horizontal fore-aft structural member connecting the pillars, and there is a plurality of structural cross-braces above the base and between the pillars, each said brace being at an acute angle to the base and having means for supporting a shelf; and in which e. the upper segment has a front pillar, a rear pillar, a horizontal top brace structurally connecting top ends of the pillars, and a plurality of upper structural cross-braces below the top brace and between the pillars, each upper brace being at an acute angle to the top brace and having means for supporting a shelf.

10. The rack of claim 9, in which the upper and lower side segments meet at a level which is spaced from and is in between an adjacent pair of shelves and an adjacent pair of braces.

11. A rack according to claim 9 in which the upper and lower segment pillars have pilots and respective complemental means for receiving the pilots, and in which the pilots and pilot receiving means have means for positively locking the upper and lower segments together.

12. The rack of claim 9, in which each end side has a front and a rear stanchion and the outside of truss braces, and a billboard in between the stanchions, said billboard being the full height of the end side and being in discrete upper and lower sections.

13. The rack of claim 12, in which each stanchion has an internal channel for holding the billboard, said channel being in between the respective braces and an outer member of each respective stanchion.

14. The rack of claim 12, in which the billboard is divided into upper and lower sections at the same level as where the end side is divided into upper and lower segments.

15. The rack of claim 12, in which the billboards are inside of the stanchion and are backed up by shelf supports between the stanchions.

16. A display rack having a pair of opposed end sides, transverse structural members between the sides, and shelves in between and supported by the sides, in which each end side comprises a. a lower side segment having a base at its bottom and support means for supporting an upper segment at its top, b. an upper side segment having a bottom engaged and supported by the support means, in which c. the end sides are the longest components of the rack, while the side segments are substantially shorter and are of a length equal to or less than the width of the rack, in which d. each end side has a front and a rear stanchion, and a billboard in between the stanchions, said billboard being the full height of the end side and being in discrete upper and lower sections, said display rack comprising a plurality of rectangular sheet back panels, a central one of said panels overlapping vertically onto both segments on both sides and being positively fastened onto both upper and both lower segments to positively retain said segments vertically to each other.

17. A display rack comprising a. a pair of opposed and spaced apart end sides, each end side having a front stanchion and a rear stanchion;

b. a plurality of spaced apart shelves in between the end sides, said shelves being tilted downward from the back to the front;

c. a rear top header between tops of the rear stanchions, said header having a rear panel and a support panel generally parallel to said rear panel;

d. a front top header between tops of the front stanchions said front header having a front panel;

e. a top panel in between the headers;

f. said support panel on said rear top header supporting a rear edge of said top panel above a bottom of the rear panel;

g. means on said front top header which are adjacent to the bottom of said front top header for supporting the front edge of said top panel, said top panel being jointly supported by both supporting means and being held upon both said supporting means by a back of the front panel, said top panel being parallel to an uppermost of the shelves.

18. A display rack according to claim 17, in which the rear header has a J shape.

19. A display rack according to claim 17, in which the front panel is perpendicular to the uppermost shelf and to the top panel.

20. A display rack according to claim 19, in which the uppermost shelf extends substantially forward of the plane of the front panel and forward of the front stanchions.

* * * * *